US007059637B2

(12) United States Patent
Stewart et al.

(10) Patent No.: US 7,059,637 B2
(45) Date of Patent: Jun. 13, 2006

(54) BOOK MARKING AND NOTE TAKING APPARATUS

(76) Inventors: Anna M. Stewart, 692 Highland Ave., Atlanta, GA (US) 30312; Stephen Kraigh Stewart, 692 Highland Ave., Atlanta, GA (US) 30312

( * ) Notice: Subject to any disclaimer, the term of this patent is extended or adjusted under 35 U.S.C. 154(b) by 3 days.

(21) Appl. No.: 10/993,864

(22) Filed: Nov. 20, 2004

(65) Prior Publication Data

US 2005/0110267 A1 May 26, 2005

Related U.S. Application Data

(60) Provisional application No. 60/524,264, filed on Nov. 21, 2003.

(51) Int. Cl.
*B42D 9/00* (2006.01)

(52) U.S. Cl. ..... 281/42; 281/45; 116/234; 116/237; 116/238; 116/239; D19/34; D19/65; 24/67 R; 24/67 AR; 24/901; 40/658; 40/666

(58) Field of Classification Search ..... 281/42, 281/45; 116/234, 238, 239, 237; D19/34, D19/65; 40/658, 666; 24/67 R, 901, 67 AR
See application file for complete search history.

(56) References Cited

U.S. PATENT DOCUMENTS

| | | | | |
|---|---|---|---|---|
| 5,283,091 | A * | 2/1994 | Darvell et al. | 428/41.6 |
| 5,377,612 | A * | 1/1995 | Catalano et al. | 116/234 |
| 2002/0139291 | A1* | 10/2002 | Roundy | 116/234 |
| 2003/0075099 | A1* | 4/2003 | Dowdle et al. | 116/235 |

OTHER PUBLICATIONS http://www.3m.com, Aug. 1, 2003.*

* cited by examiner

*Primary Examiner*—Boyer Ashley
*Assistant Examiner*—Mark Henderson
(74) *Attorney, Agent, or Firm*—George R. Reardon

(57) ABSTRACT

The invention is comprised of at least one bookmark having a supply of repositionable self-stick notes disposed thereon. The invention may also have a non-intrusive paperclip-like attaching means disposed on the bookmark. The invention is disposed for advertising, logos and the like.

6 Claims, 10 Drawing Sheets

2

BOOK MARKING AND NOTE TAKING APPARATUS

This application claims priority to provisional application 60/524,264, dated Nov. 21, 2003, which is incorporated herein in its entirety.

BACKGROUND

1. Field of the Invention

The present invention relates to the field of book marks and note-taking.

2. Background of the Invention

Prior solutions to the marking of selected pages, in a book, a report, or the like have included traditional bookmarks, paperclips, pieces of scrap paper, a separate pad of Post-it® Notes, etc. Each of these solutions has drawbacks.

Using bookmarks to mark multiple places in a book or report is not feasible since the user generally has only one bookmark. Using paperclips can damage the page. The use of scrape paper is messy and does not look professional. Pads of Post-it® Notes are not always handy, convenient or of the desired size.

U.S. Pat. No. 6,526,906 to Bidanset pertains to a page marking device. The marking device is part of a book. The book has a tab assembly carrier. The carrier has a plurality of removable tabs disposed on the carrier. Printed indicia are located on the tabs. The tabs are secured to the carrier by a non-aggressive adhesive, allowing the tabs to be removed from the carrier relocated and/or removed again as required by the user of the device. Printed indicia may also be located on or beneath said carrier.

In contrast, the device shown by the Remmy patent, U.S. Pat. No. 3,958,816, shows a marking apparatus and method for books; double sided tabs have adhesive so that the tabs may be adhered to pages of books, with a number-bearing portion of the tab extending from the page. Adhesive occupies one-half of one side of the tab, and numbers are written in opposite directions on opposite sides of the tab so that the tab may be affixed to a left or right page of a book to clearly mark the page and the point on the page to which it refers. Learning key cards have numbers corresponding to the tabs. Brief notes are written on the lines, and the cards are attached to the front leaf of a book. The tabs are attached directly to the learning key, or they are attached on the inside of a cover or opposite leaf of the book. An envelope or jacket-type holder is adhesive-backed for fastening to an inside of the book, and the tabs are mounted on a release coating on the outside of the envelope-pocket. Learning key cards, each with individual numbers corresponding to the tabs, are inserted in the pocket so that an entire card is available for notes in reference to the corresponding tab.

While the above mentioned patents are a good start, none of them address combining a book mark with a convenient source of note-taking. Therefore, it is an object of the present invention to provide for an apparatus that is enabled for marking selected pages while also serving as a source for recording information about those selected pages.

SUMMARY OF THE INVENTION

The aforementioned and other objects were achieved by the present invention which is a book marking and note taking apparatus.

Additional objects and advantages of the invention will be set forth in part in the description which follows, and in part will be obvious from the description, or may be learned by practice of the invention. The objects and advantages of the invention will be obtained by means of instrumentalities in combinations particularly pointed out in the appended claims.

The invention pertains to a bookmark having a supply of repositionable self-stick notes for recording of thoughts removably attached to a repositionable self-stick notes attaching area. The repositionable self-stick notes attaching area is located on the front side of the bookmark. As the user is reading the book, magazine or report, the repositionable self-stick notes are conveniently at hand for recording a quote, important concept, URL, etc. The bookmark can be made of a variety of materials, can be of a variety of colors, and is enabled for logos, slogans, and the like, on any available space on the front side, the back side, or both of the bookmarks, as well as on the repositionable self-stick notes. The invention also pertains to a bookmark having a supply of repositionable self-stick notes plus target object attaching means, in the form of a die cut clip, an injection molded clip, a slightly sticky adhesive, or other solutions well know in the art. While the die cut clip and injection molded clip will usually be made to fit over the page of a book or magazine, they may also be made to fit over a shirt pocket, jacket pocket, car visor, etc. Additionally, the invention pertains to a page insert containing at least one of a removable bookmark with a supply of repositionable self-stick notes, either with or without page attaching means, and with or without promotional or advertising information.

An object of the invention is to put the repositionable self-stick notes conveniently in the hands of book and magazine enthusiasts. An additional object of the invention is to create an additional item that can be used for advertising and promotions.

An additional object of the invention is to connect in the mind of the consumer the use of repositionable self stick notes and the act of using these notes "on the go", e.g., clips in their jacket or shirt pocket, clips in their car on a visor, and the like.

BRIEF DESCRIPTION OF THE DRAWINGS

The accompanying drawings illustrate a complete embodiment of the invention according to the best modes so far devised for the practical application of the principles thereof, and in which.

DETAILED DESCRIPTION OF THE INVENTION

The preferred embodiment of the invention, 1, is comprised of a page bookmark, 2. The page bookmark, 2, is further comprised of a built-in page clip, 3. The page clip, 3, is formed through a shaped cut, 4, in the material that forms the page bookmark, 2. This shaped cut, 4, enables the sliding over and engaging of other thin materials, such as but not limited to, a book page. The page bookmark, 2, holds onto a page by means of tension exerted between the front of the page bookmark, 2, and the page clip back, 3*b*, created by the shaped cut, 4. The page bookmark, 2, is further comprised of a pad of repositionable self-stick notes, 5, such as, but not limited to Post-It® Notes, that are placed directly on the page clip top, 3*a* using a non-aggressive adhesive. The repositionable self-stick notes, 5, are removably attached to each other and with a non-aggressive adhesive. The page bookmark, 2, is further comprised of a hole, 6, positioned at the top center of the invention.

Figure 1:
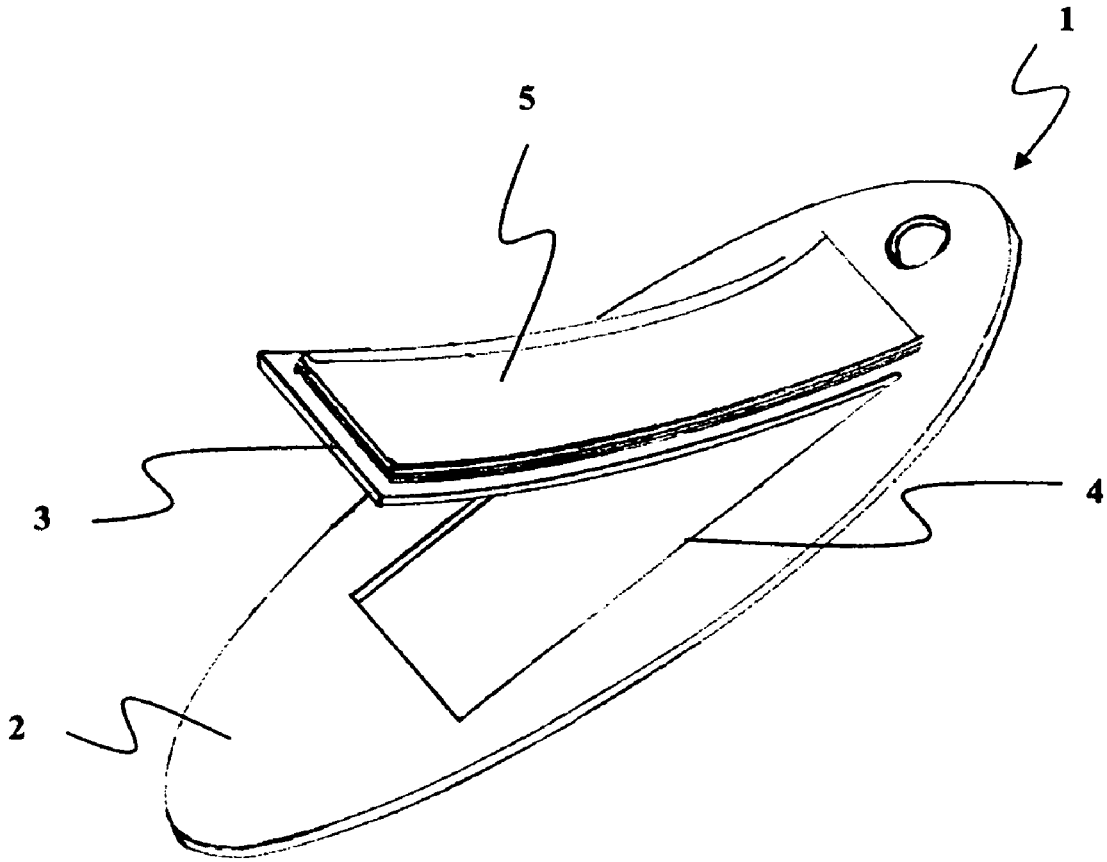
FIG. 1 shows a perspective view of a die cut embodiment of the invention.
Figure 2:
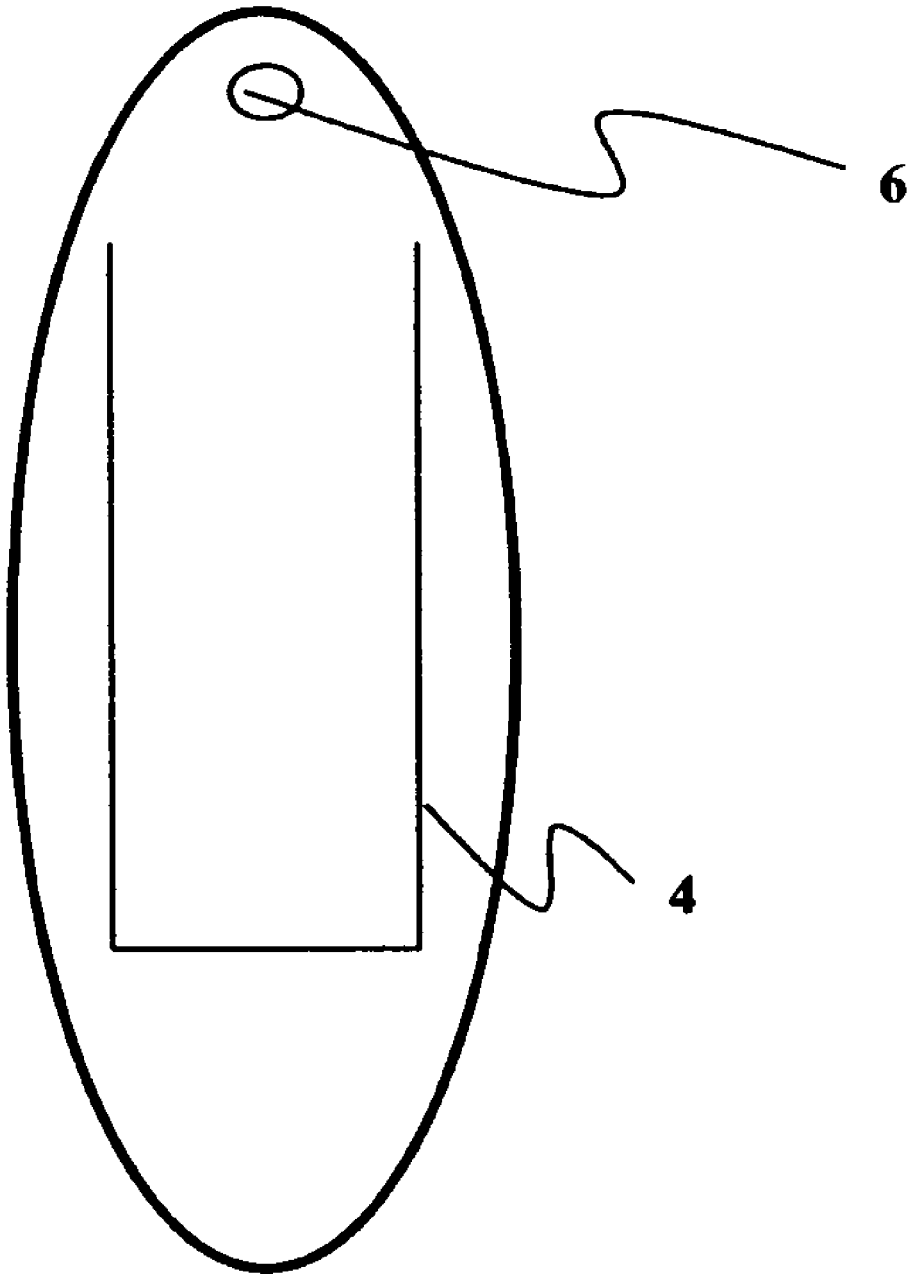
FIG. 2 shows a plan view of a die cut embodiment of the invention.
Figure 3:
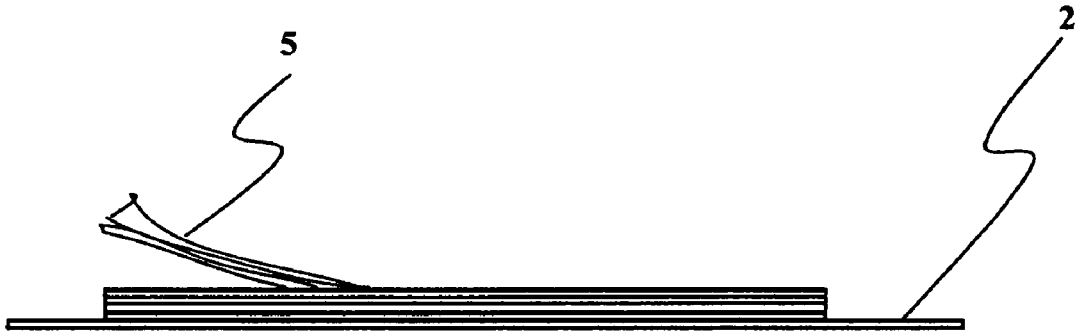
FIG. 3 shows a right side view of a die cut embodiment of the invention.
Figure 4:
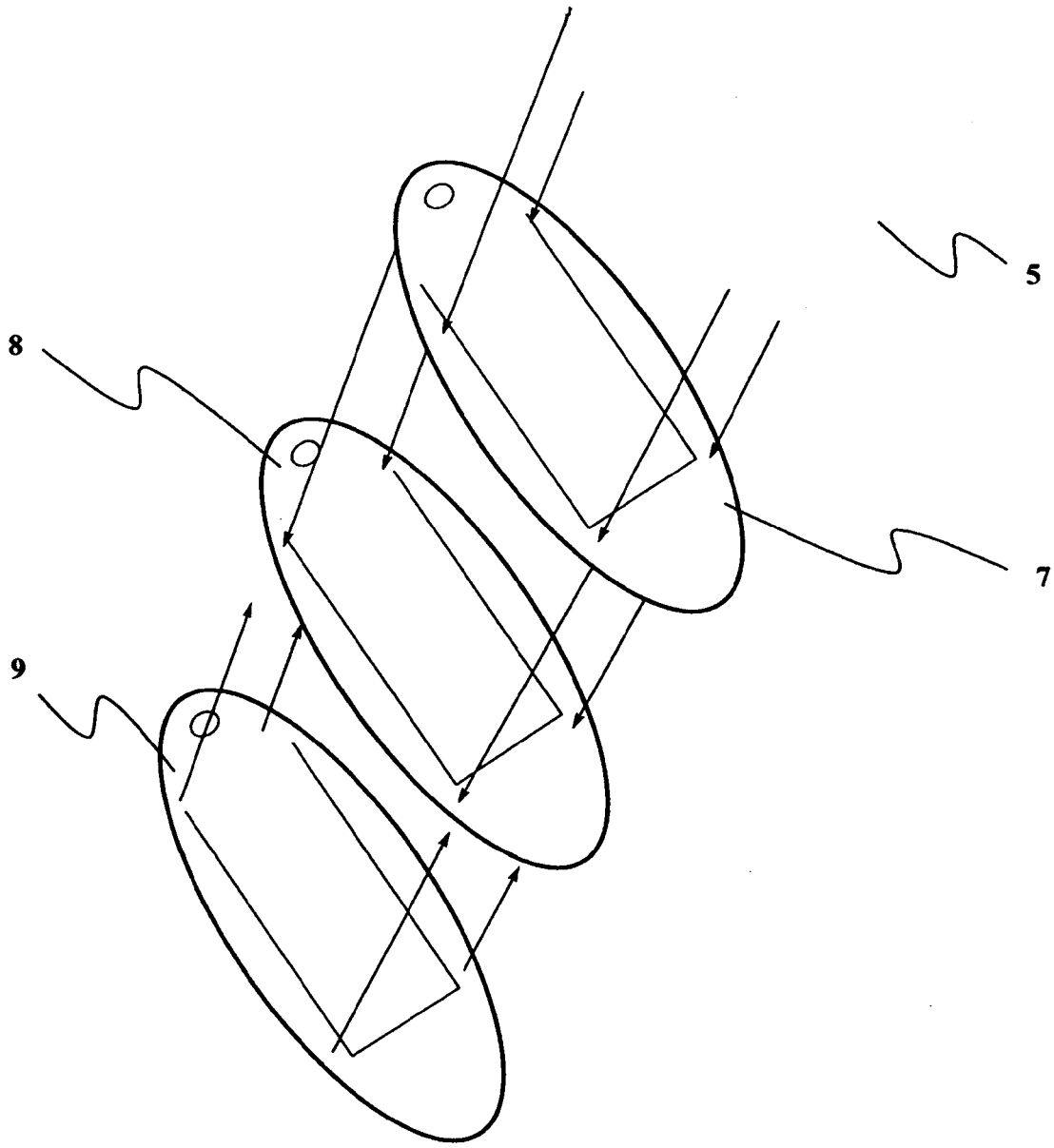
FIG. 4 shows an exploded view of a laminated embodiment of the invention.
Figure 5:
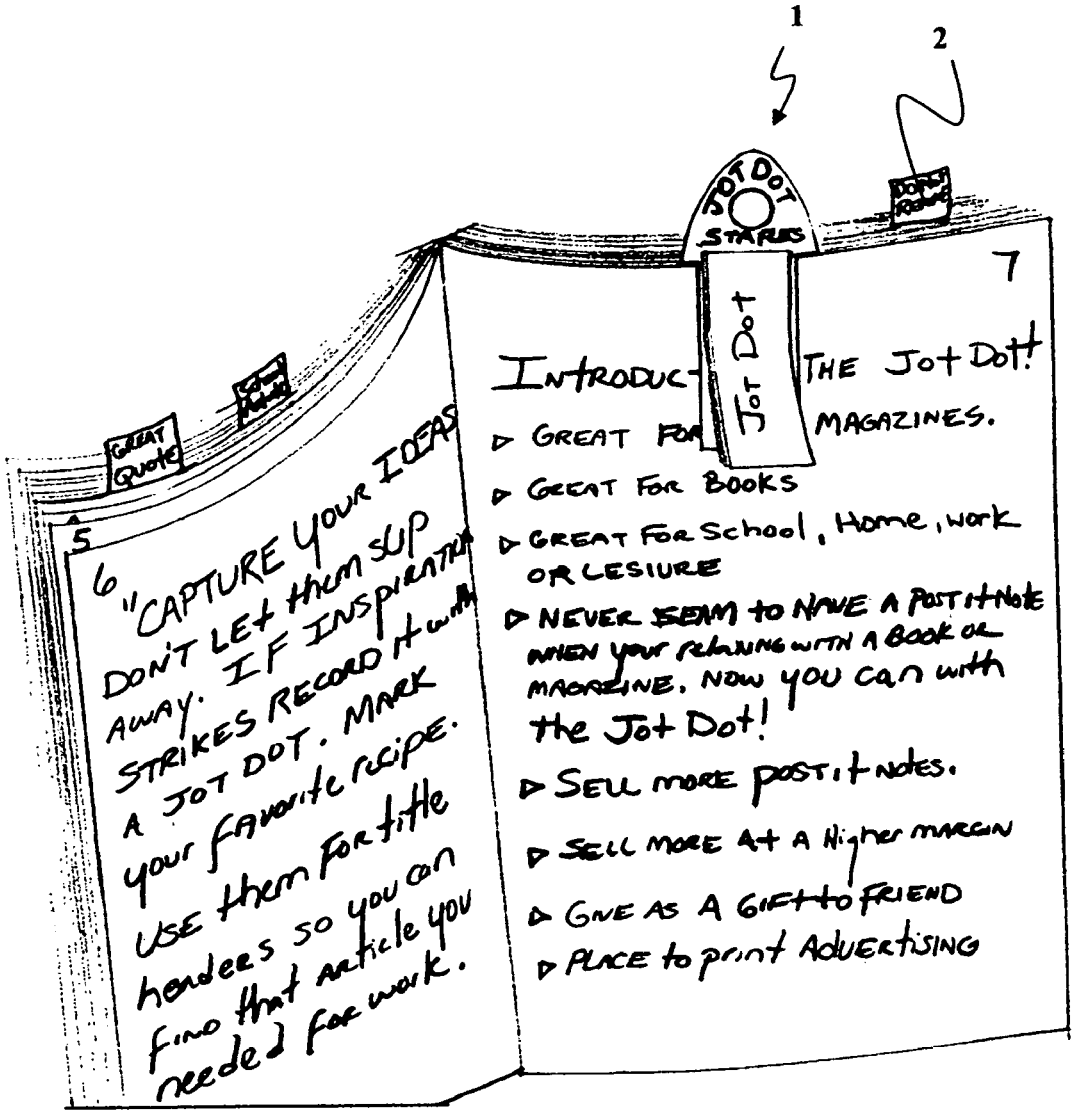
FIG. 5 shows one embodiment of the invention in use with a book.
Figure 6:
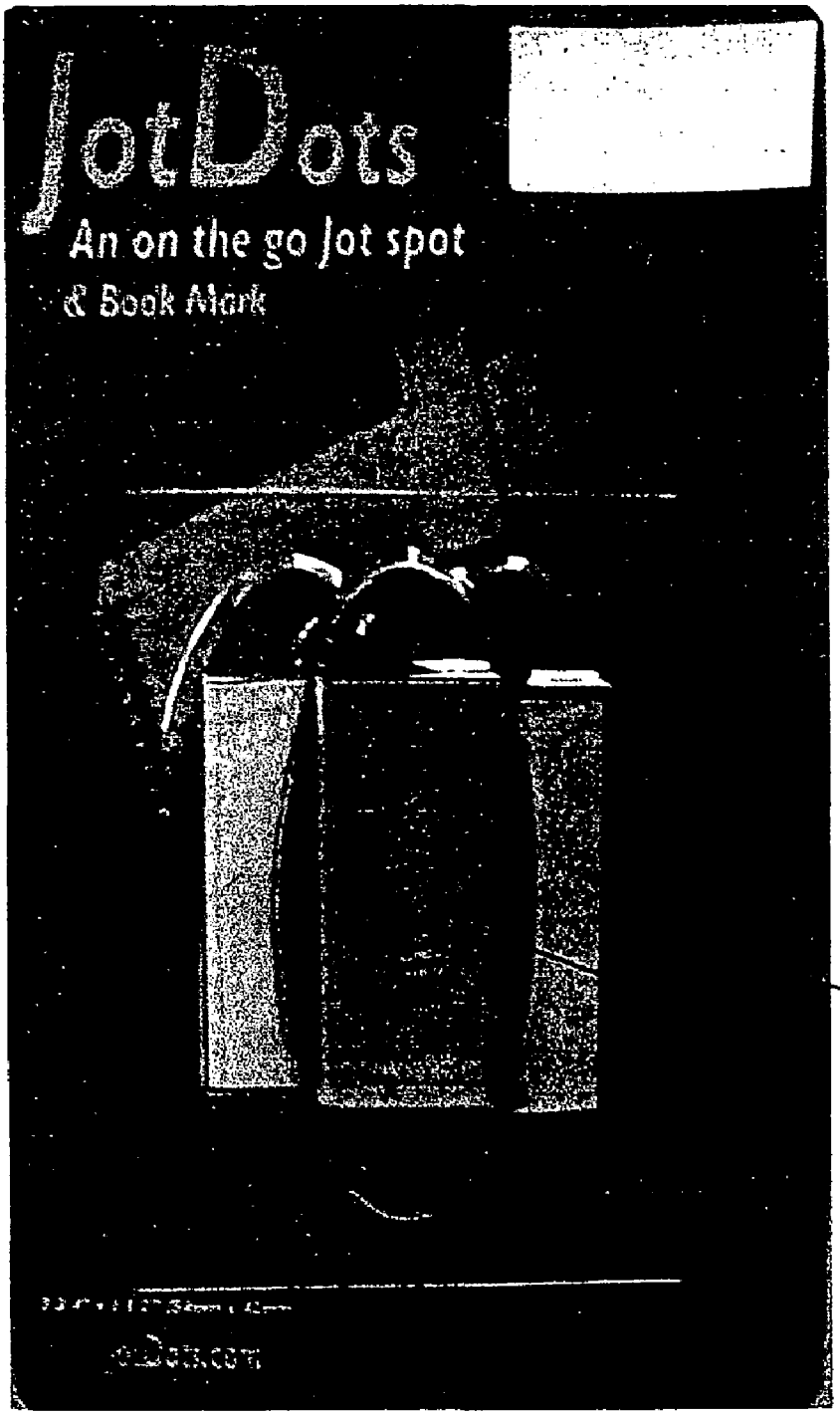
FIG. 6 shows one packaging option for presenting multiples of one embodiment of the invention.
Figure 7:
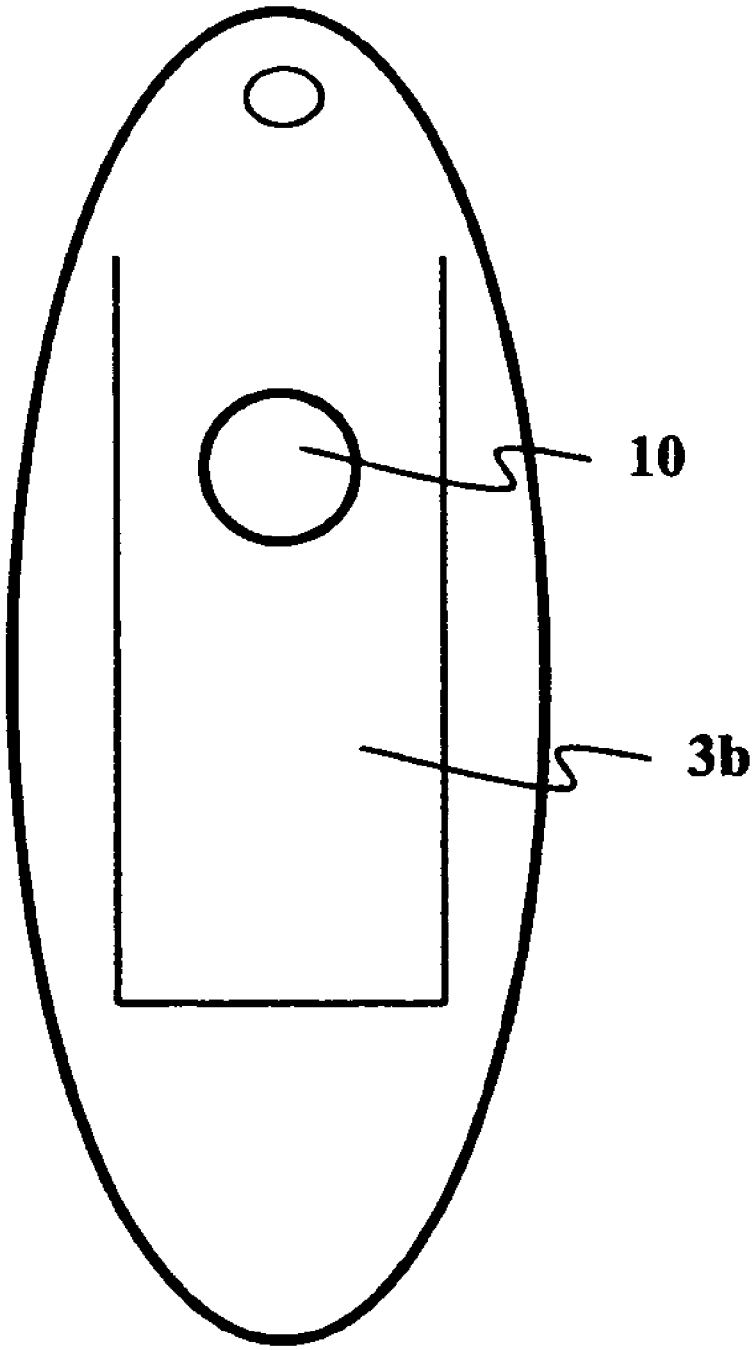
FIG. 7 shows a back view of a die cut embodiment of the invention, with a bugger dot attached.

The preferred embodiment of the invention uses a material for the page bookmark, 2, that is made from a brand of plastic known as kydex, which is a thermo plastic sheet. The page bookmark, 2, is cut into the desired shape under tonnage of pressure in a die stamping machine that is loaded with a custom made die tool. In the preferred embodiment, the page clip, 3, then has a book of 25 repositionable self-stick notes, 5, adhered to its top surface, 3*a*. Then, the completed product is preferably packaged in predetermined assorted colors in groups of three, as shown in FIG. 6.

In the preferred embodiment the page bookmark, 2, is in an elliptical shape that is 3.75" tall×1.5" wide. The shaped cut, 4, inside the interior of ellipse that forms the page clip, 3, is 2" long×1" wide. The attached repositionable self-stick notes, 5, are manufactured in books of 25 notes and each repositionable self-stick note, 5, measures 2.375" long×1" wide.

In another embodiment of the invention, 1, the page bookmark, 2, is given more holding power by adding an adhesive glue dot, 10, known in the industry as a double side permanent film adhesive sticker or bugger dot, to the page clip back, 3*b*. The adhesive glue dot, 10, has a similar tackiness comparable to that of the adhesive on the back of the repositionable self-stick notes, 5. The function of this adhesive sticker is to add holding power to the invention and assist staying in place while in use during transport of the book, magazine, document or other.

The present invention may be comprised of additional cutouts for purposes of design. Additionally, the shape represented in these drawings is only one such possible shape. The invention is not limited to this shape. Also, the shaped cut, 4, may vary to enable the invention, 1, to be used on a shirt pocket, a car visor, etc., which have a thickness that is different than that of a book or magazine page.

Figure 8:
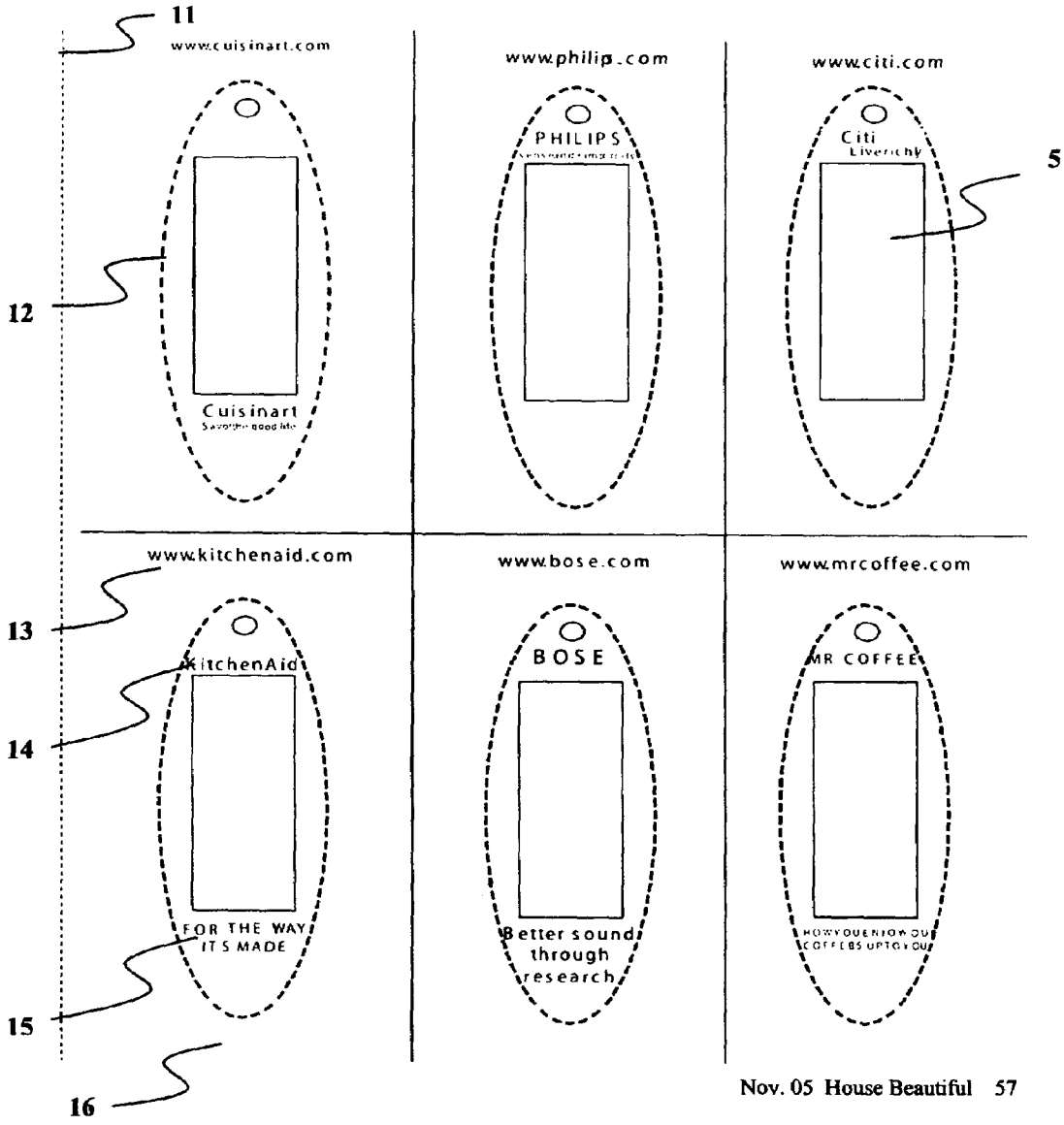
FIG. 8 shows a front view of a page insert embodiment of the invention.
Figure 9:
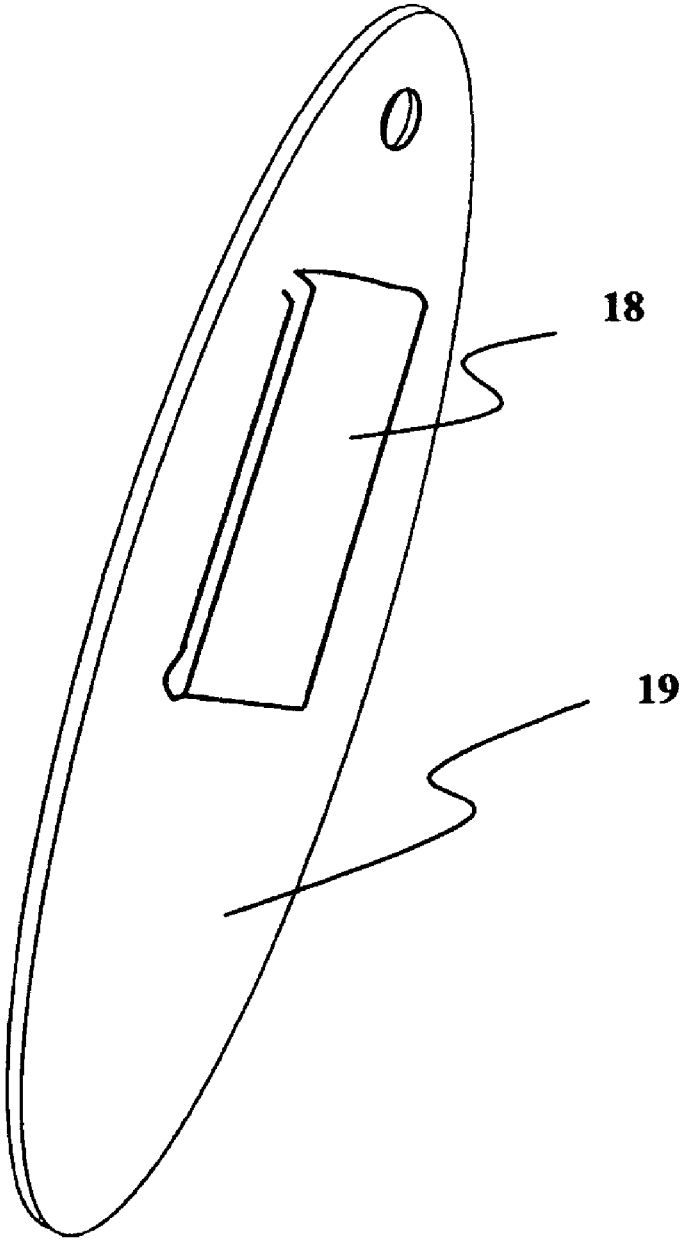
FIG. 9 is a perspective view of an injection molded embodiment of the invention.
Figure 10:
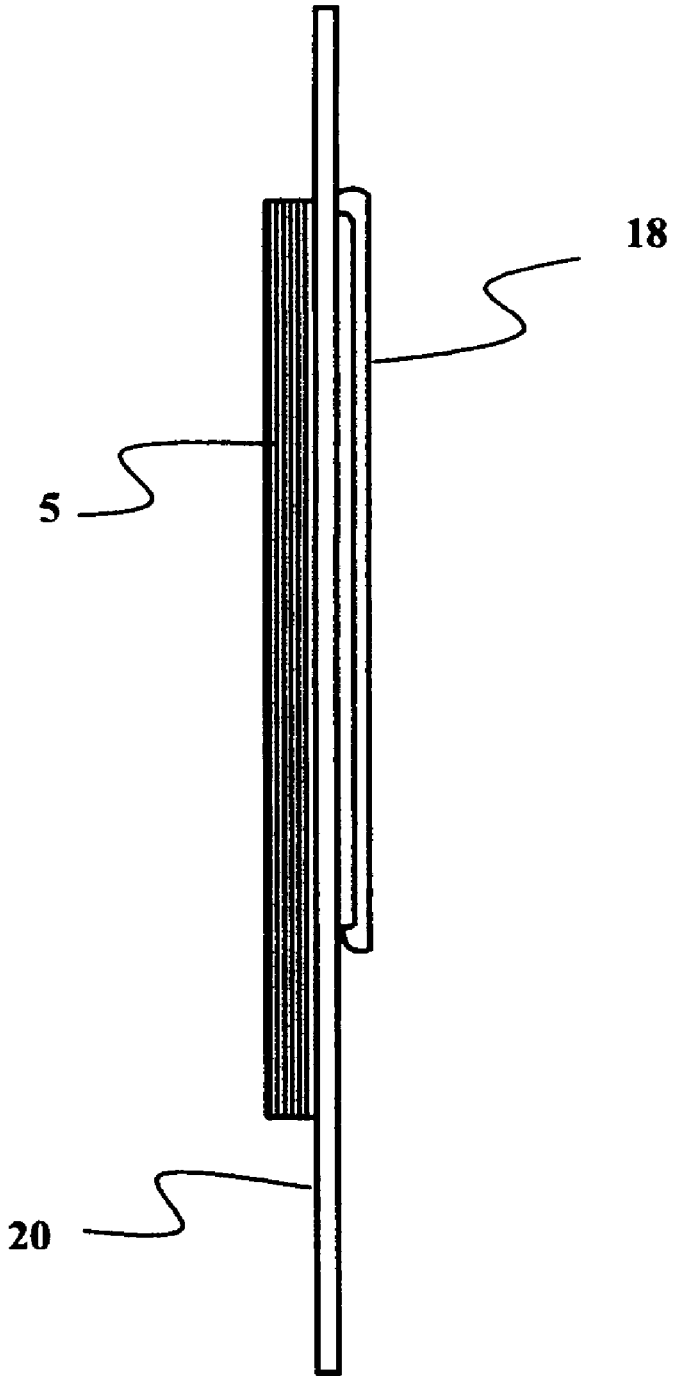
FIG. 10 is a side view of an injection molded embodiment of the invention.

In another embodiment the present invention is further comprised of a page insert, 17, containing at least one of the page bookmarks, 2, assembled such that each page bookmark, 2, can be detached from the page insert, 17. One possible arrangement of the page insert, 17, containing multiple removable page bookmarks, 2, is shown in FIG. 8. The embodiment shown in FIG. 8 is further comprised of a page perforation, 11, positioned on the side of the page closest to the spine of the magazine. The embodiment shown in FIG. 8 is further comprised of a bookmark perforation, 12, that allows the user to remove the page bookmark, 2, from the page insert, 17. This embodiment is further comprised of a first advertising space, 13, a second advertising space, 14, a third advertising space, 15, and a fourth advertising space 16. In addition to the advertising spaces mentioned above, the repositionable self-stick notes, 5, may have a watermark containing a logo, slogan or other information. This watermark is preferably on the top surface of the repositionable self-stick notes, 5.

One reason for having a page insert, 17, of page bookmarks, 2, in a publication for the consumer is to add value to the consumer's purchase and offer a way of recording and marking the consumer's inspirations, ideas, favorite spots etc. Another reason for having a page insert, 17, from the publisher's point of view is give the publisher's advertisers a novel, attention-getting way to advertise within a publication—thus generating more advertising dollars. From an advertiser's perspective this design of the invention allows the readers to take the advertising with them after they have finished reading the magazine, thus adding bonus value by the advertisement staying longer in the minds of their perspective customers. The magazine page can be designed in such a way with full color pictures and advertisements just as you might see in any publication in the store today. The magazine page could be made by an outsourced company that could take the art work provided by the publisher's advertisers and create custom pages to supply back to the publishers for adding in during assembly. Another possible way to handle the production of these pages in to create software and a process that allows customization and production of these pages by the publisher in-house.

In another embodiment of the invention, the page clip back, 3*b*, has an adhesive glue dot, 10, affixed to the page clip back, 3*b*, to attach each page bookmark, 2, to the desired page in the magazine.

Another embodiment of the invention is the laminated version. This embodiment utilizes printed paper or card stock, 8, of specific company or store advertisements sandwiched between two layers of clear laminating film, designated as the front layer clear lamination film, 7, and the back layer, clear lamination film, 9. Between the front layer clear lamination film, 7, and the back layer, clear lamination film, 9, is placed a corresponding shaped, paper or card-stock, 8. This assembly is then die cut and heat sealed. The repositionable self-stick notes, 5, are then affixed on top of the front layer lamination film, 7, preferably using an adhesive, such as, but not limited to, glue.

The page bookmark, 2, can be made from a variety of materials such as, but not limited to, cardboard, plastic or metal. Metals that could be used include, but are not limited to, aluminum, stainless steel, mild steel, brass, and the like.

The process for making the page bookmark, 2, from metal includes, but is not limited to, die stamping thin gauge metal sheet stock from a custom made die, laser cutting that is programmed from a CAD file of the page bookmark, 2, or water jet cutting programmed from a CAD file of the page bookmark, 2, to achieve the invention shape desired.

Additionally, thinly cut wood, wood veneer or wood/resin backing sheets could be utilized for the laminating process. The process would involve using a custom made die cutting stamp to achieve the desired shape.

Also a wide variety of thin plastics could be used to form the page bookmark, 2. The process would involve using a custom made die cutting stamp to achieve the desired shape.

Laminates can be used for attaching to wood substrates. The process would involve using a custom made die cutting stamp to achieve the shape Paper/cardstock can be used to create the page bookmark, 2. Virtually any type of paper product that is at least of 140 lb density can be used. The process would involve using a custom made die cutting stamp to achieve the shape desired.

The hole, 6, has a variety of potential uses. One is to serve as a place for the user's fingers to grab and pull the page bookmark, 2, out of its placement in a book, magazine, page, etc. The hole, 6, also enables the page bookmark, 2, to be placed on a hook on a wall for storage. Another possible use for the hole, 6, is to put a string, cord or necklace type chain through the hole, 6, for those situations where the user needs access to a lot of self stick notes, e.g., collecting information at a trade show and needing to mark literature with important reminders or specific notes. In these situations it is important for the user to have his/her hands free. Yet another possible use for the hole, 6, is that it allows the page bookmark, 2, to be clipped into a three ring binder notebook, or into any similar type of clip, such as a key ring.

Yet another embodiment of the page bookmark, 2, involved injection molding where a one piece molded design is created with the repositionable self-stick notes attaching area and the page attaching means are on opposite sides of the page bookmark, 2. Unlike the die cut version where these two areas are interconnected, the molded embodiment segregates these features, thus clearly defining the front of the page bookmark, 2, as the self-stick notes attaching area and the back as the page attaching means. This embodiment of the page bookmark, 2, is enabled for advertising and promotion around and on the repositionable self-stick notes, 5, and on the front side as well as on the back side of the page bookmark, 2. Information, logos and other information can be applied, either at the time of molding or as a secondary process.

Yet another embodiment of the page bookmark, 2, has a separate repositionable self-stick notes attaching area and page attaching means. This embodiment consists of two separate parts that are permanently attached to each other (glued, mechanically, heat or otherwise bonded, fastened, connected or other) to form a single piece design. This embodiment can be a variety of shapes and sizes and would also clearly define the front as the self-stick notes attaching area and the back as the page attaching means. This embodiment shares the trait of offering advertising and promotion space around and on the front side as well as on the back side of the page bookmark, 2, as well as on the repositionable self-stick notes, 5.

Still another embodiment of the invention pertains to the absence of any page attaching means. In this embodiment, the repositionable self-stick notes attaching area is located on the front of the page bookmark, 2. In this embodiment the invention can be held into a book or magazine by a sandwiching effect of pushing the edge of the invention into the binding. This embodiment can be further comprised of an adhesive placed on the back side of the page bookmark, 2, of similar composition to that of the repositionable self-stick notes, 5, to assist in holding the page bookmark, 2, in place while in use. This embodiment is also enabled for advertising and promotion both on the front and back sides of the page bookmark, 2, as well as on the repositionable self-stick notes, 5.

What is claimed is:

1. A book marking and note taking apparatus comprising:

a page bookmark, wherein said page bookmark is further comprised of a repositionable self-stick notes attaching area;

repositionable self-stick notes attaching means;

repositionable self-stick notes; and target object attaching means;

wherein said page bookmark is made of card stock.

2. A book marking and note taking apparatus comprising:

a page bookmark, wherein said page bookmark is further comprised of a repositionable self-stick notes attaching area;

repositionable self-stick notes attaching means;

repositionable self-stick notes;

target object attaching means; and

A bugger dot on the back side of said target object attaching means.

3. A book marking and note taking apparatus comprising:

a page bookmark, wherein said page bookmark is further comprised of a repositionable self-stick notes attaching area;

repositionable self-stick notes attaching means;

repositionable self-stick notes;

target object attaching means; and a hole disposed in said page bookmark above said target object attaching means.

4. A book marking and note taking apparatus comprising a page bookmark, wherein said page bookmark is further comprised of a plastic material having a front side and a back side, wherein said front side and said back side are roughly co-planar;

a shaped cut in said plastic material forming a page clip operable for sliding over and engaging a thin material; and a pad of repositionable self-stick notes disposed on said front side of said plastic material.

5. The book marking and note taking apparatus of claim 4, further comprising a hole positioned at the top center of said page bookmark.

6. The book marking and note taking apparatus of claim 5, wherein said thin material is a book page.

* * * * *